United States Patent [19]

Larson et al.

[11] 3,999,419

[45] Dec. 28, 1976

[54] BODY AND FRAME STRAIGHTENING MACHINE

[76] Inventors: Byronn Arvid Larson, 116 La Crosse, South San Francisco, Calif. 94080; Richard George White, 835 E. 74th, Anchorage, Alaska 99502

[22] Filed: Mar. 12, 1975

[21] Appl. No.: 557,602

[52] U.S. Cl. ..... 72/457; 72/705

[51] Int. Cl.[2] ..... B21D 1/12

[58] Field of Search ..... 72/705, 457

[56] References Cited

UNITED STATES PATENTS

| | | | |
|---|---|---|---|
| 2,140,686 | 12/1938 | Bennett | 72/705 X |
| 2,442,425 | 6/1948 | Merrill et al. | 72/705 X |
| 2,522,167 | 9/1950 | Englehart | 72/705 X |
| 3,050,099 | 8/1962 | Smith | 72/705 X |
| 3,518,867 | 7/1970 | Rouis | 72/705 X |
| 3,630,066 | 12/1971 | Chisum | 72/705 X |
| 3,729,978 | 5/1973 | Lunardini | 72/705 X |
| 3,777,541 | 12/1973 | Whitney | 72/705 X |
| 3,835,693 | 9/1974 | Majersky | 72/705 X |

FOREIGN PATENTS OR APPLICATIONS

| | | | |
|---|---|---|---|
| 119,363 | 12/1944 | Australia | 72/705 |
| 2,145,992 | 3/1973 | Germany | 72/705 |
| 338,753 | 9/1971 | Sweden | 72/705 |

*Primary Examiner*—C.W. Lanham
*Assistant Examiner*—D. M. Gurley
*Attorney, Agent, or Firm*—Henry G. Kohlmann

[57] ABSTRACT

This invention relates generally to horizontal frames for supporting damaged motor vehicles and allowing various pulling operations to be performed thereon. These pulling operations are performed by anchoring of the vehicles to the frame and force applied to the damaged sections of said vehicles through a pulling means supported by a generally L-shaped device which cooperates with said frame thereby restoring said damaged vehicle to its original configuration.

2 Claims, 11 Drawing Figures

BODY AND FRAME STRAIGHTENING MACHINE

BACKGROUND OF THE INVENTION

1. Field of the Invention

This invention relates generally to horizontal frames which support motor vehicles and allow various pulling operations to be performed thereon. More specifically this invention relates to such frames which support motor vehicles, provide attachment points for securing a vehicle thereto and allow various kinds of pulling devices to be secured thereto such that pulling forces may be applied to a damaged section of a vehicle, thereby restoring damaged section to its original configuration.

2. Description of Prior Art

There are various forms of such machines typified by the patent issued to Rouis U.S. Pat. No. 3,518,867. However, in each of these devices the actual pulling force is applied through a pulling means secured to the vertical section of L-shaped member attached to the horizontal frame or towers either attached to the frame directly or anchored in the floor in a fixed relation relative to said frame.

The disadvantage is these prior art devices is that, in the case of the L-shaped member, the device must by some means, for example, a chain, bolt or clamp, by physically attached to the horizontal frame. This requires excessive additional time and effort because usually several pulling operations are required at different locations about the supported vehicle. In addition there is increased danger to the workmen using the equipment because they are required to crawl underneath the frame or extend their arms into the machine to make the required attachments. Where towers are employed the disadvantage lies in the fact that when in a fixed position relative to frame a pulling force may be required in a direction where no tower is available. Where movable towers are employed there exists the same difficulty as with the L-shaped member, namely the tower must be attached to the frame and requires additional time and effort and further results in increased danger to workmen because they are required to crawl underneath the frame or extend their arms into the machine.

In contrast, an object of the present invention is to eliminate any requirement for securing an L-shaped member to the horizontal frame and provides a construction wherein the normal forces required to allow the various pulling operations to be performed will also hold the L-shaped member or tower in a fixed position relative to the frame. Accordingly, there is no danger to workmen because they need not crawl under the machine nor do they need to extend their arms into the machine. Once the pulling chain or cable and the means for pulling such chain or cable is attached between the vertical section of the L-shaped member and the workpiece no further connections are necessary. Speed and ease of application are increased by elimination of an unnecessary step in the pulling process.

The prior art shows the horizontal frame constructed of longitudinal members spaced apart with fixed end members transverse to said longitudinal member, the entire structure forming a rectangle in a generally horizontal disposition. Also shown by prior art are adjustable transverse members which slide in slots in the longitudinal members or between double longitudinal members. The disadvantage lies in the fact that when these slots are in the longitudinal members, which are generally hollow, the necessary force, which can range as high as ten tons causes a distention of the slot and requires heavy construction of the longitudinal members to withstand such distention. Where double longitudinal members are used there is no distention but results in increased construction costs due to multiple member construction. Therefore, another object of the present invention is to show a simplified frame construction which provides the required strength without distention and supports at least one adjustable transverse member.

Further the prior art shows such frames in a fixed horizontal position requiring the vehicle to ascend a substantial incline. This is particularly difficult when such vehicle is damaged and cannot run under its own power. Therefore, it is an object of this invention to provide a frame machine which can be lowered at one end allowing the vehicle to be easily placed thereon. Some prior art teaches the lowering of one end of the machine as in the patent to Chisum U.S. Pat. No. 3,630,066, however, such construction is usually bulky and expensive requiring multiple lifting devices to return it to the horizontal. Further, such prior art devices rely on the lifting devices to maintain the horizontal position thereby increasing the danger to workmen by premature tilting of the machine should a lifting device fail.

Accordingly, it is another object of this invention to provide an inexpensive simplified lifting means that will not only allow tilting of the horizontal frame but will also provide a rigid support for holding the frame in a horizontal position.

The prior art further teaches construction of such frames comprising a plurality of front transverse members so as to allow anchoring of the vehicle irrespective of vehicle length. The disadvantage of such devices is that because the transverse members are in a fixed position many such members spaced longitudinally of the frame are required in application resulting in increased cost. Further, difficulty in application results where anchoring or jacking is required in a solely vertical direction because the vehicle itself must be properly positioned. An object of the present invention is to provide a simplified structure having an upper transverse member which is adjustable, at one end and like the previously described transverse members will not cause distention of slots in the longitudinal members. Also increased safety is an objective in that adjustment of the upper transverse member may be made without having the workman extend his arms into the machine due to the novel means of attachment of the upper transverse member to the longitudinal member.

SUMMARY OF THE INVENTION

The foregoing disadvantages of the prior art may be avoided in accordance with the principles of this invention wherein a frame straightening machine includes a horizontally disposed rectangular frame for supporting vehicles comprising a pair of longitudinal members fixed by attached at their ends to a front transverse member at its ends and a rear transverse member at its ends. Said frame being mounted on a pair of fixed legs near the front of the frame and a pair of rotatable legs near the rear of the frame and a single hydraulic unit near the rear of the frame and located between the rotatable legs for raising and lowering the rear of the frame. Said rotatable legs capable of being fixed in a vertical position when frame is substantially horizontal. Also an L-shaped member which cooperates with the frame and provides a tower from which pulling operations may be accomplished. Said frame having at least one longitudinally adjustable transverse member for suporting the L-shaped member when in cooperation with the frame, and at least one longitudinally adjustable transverse member for anchoring and jacking operations on said vehicle and for accommodating vehicles of differing length. Vehicles may be anchored anywhere about the frame by the conventional method of attaching a cable or chain both to the vehicle and about the frame members.

DESCRIPTION OF THE PREFERRED EMBODIMENT

Figure 1A:
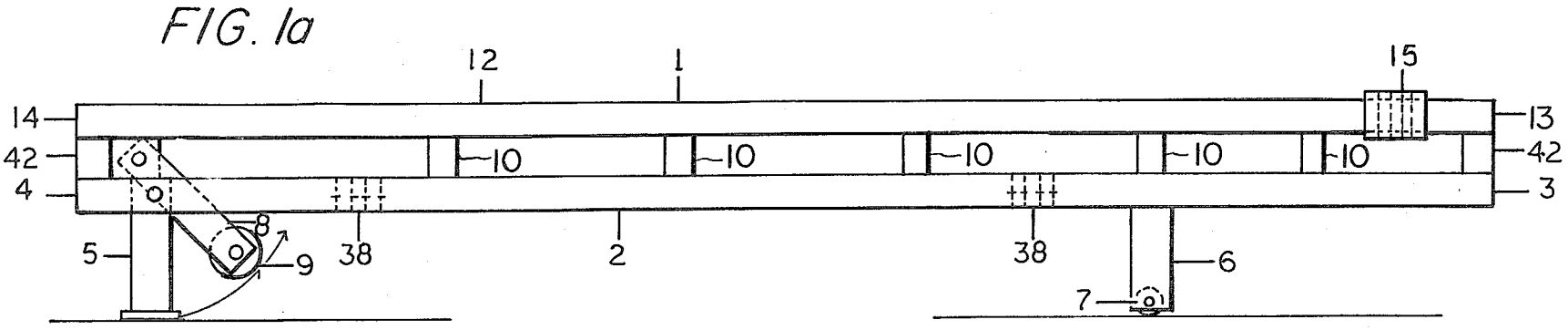
FIG. 1*a* is a side view of the horizontal frame.
Figure 1B:
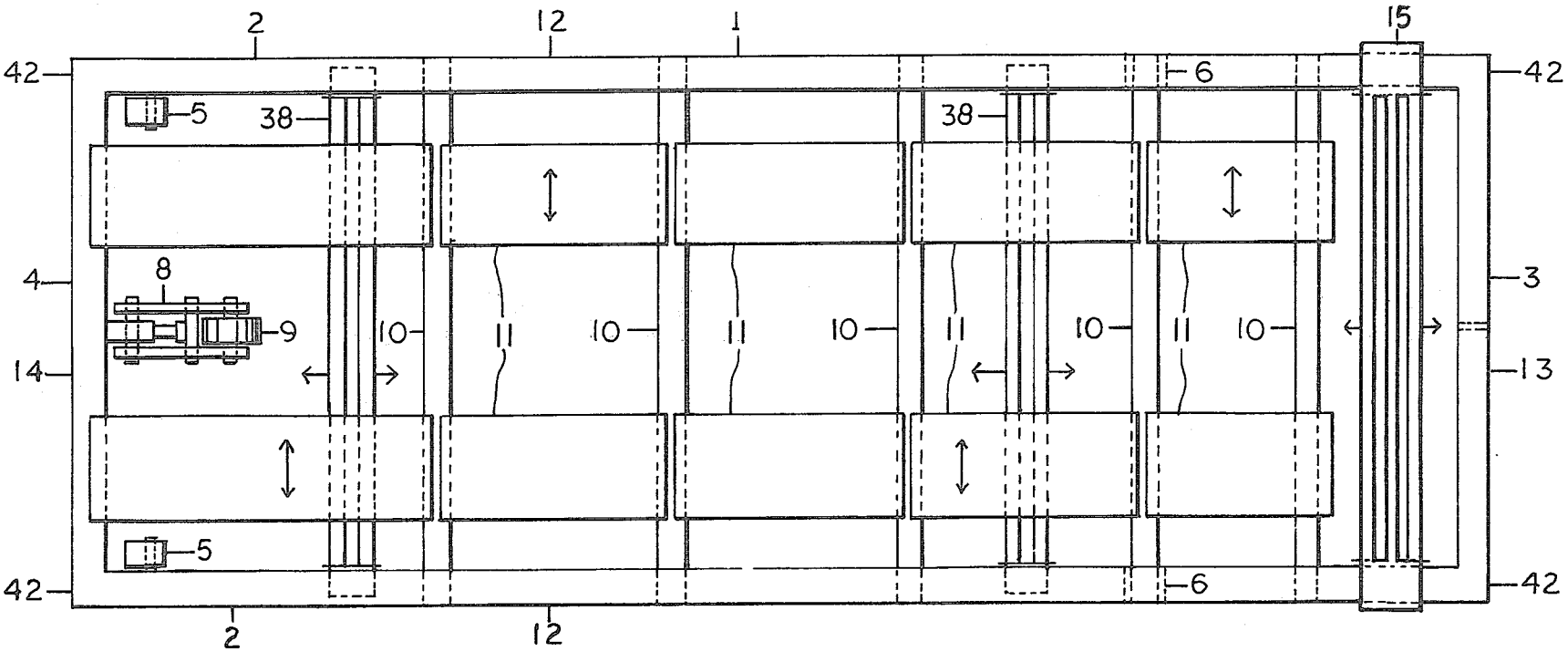
FIG. 1*b* is a top view of the horizontal frame.
Figure 2B:
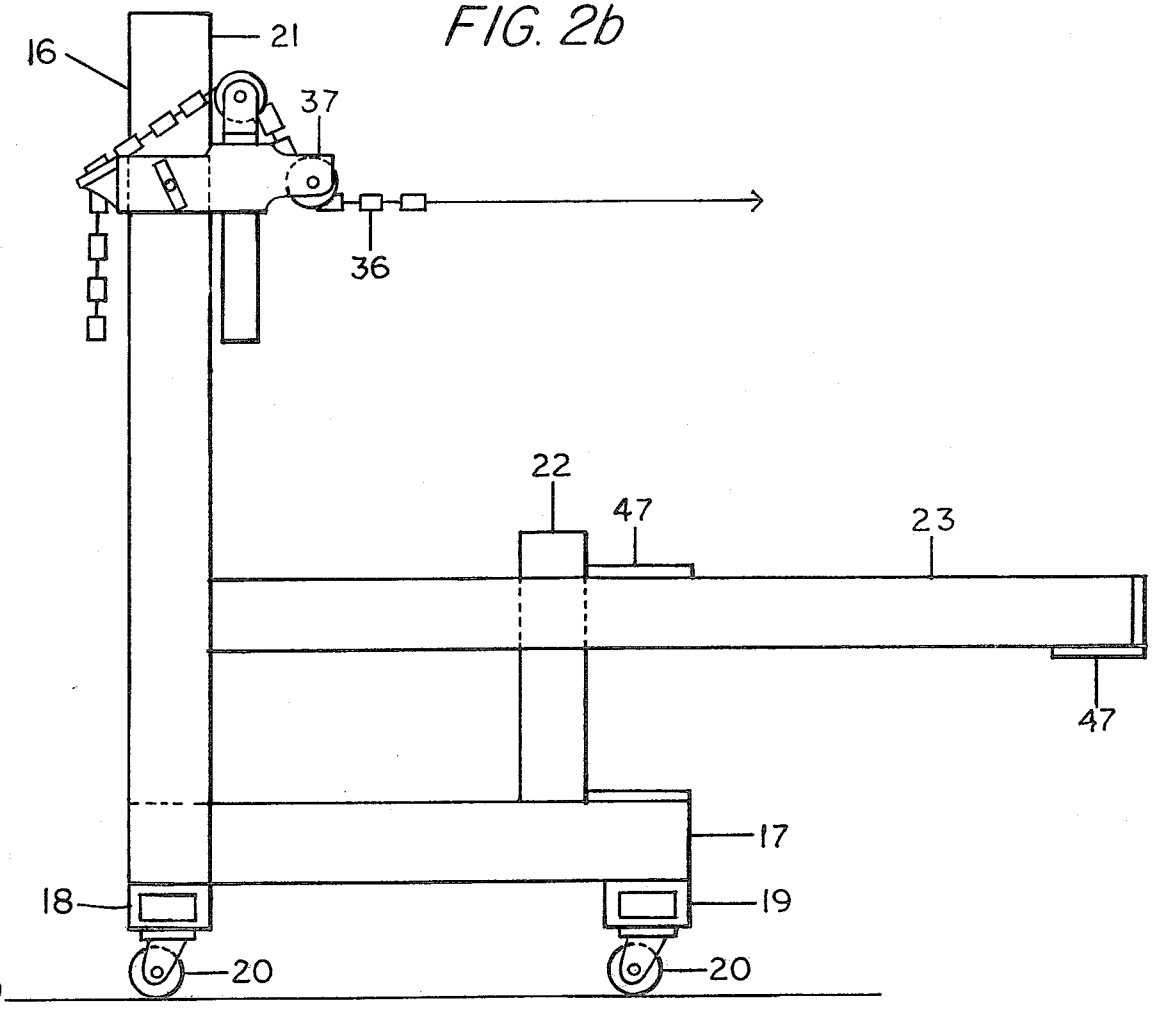
FIG. 2*b* is a side view of the L-shaped member.
Figure 2A:
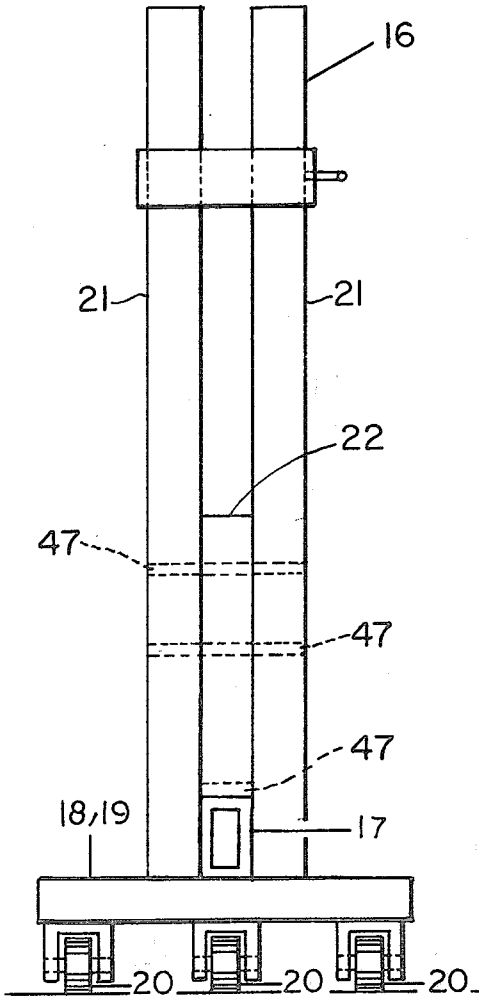
FIG. 2*a* is a rear view of the L-shaped member.

With reference to the drawing, FIG. 1*a* and 1*b* show the rectangular frame 1 with lower longitudinal members, 2 spaced apart and fixedly attached at their ends to a lower front transverse member, 3 and a lower rear transverse member 4. Said frame 1 mounted on rotatable legs 5 near the rear and fixed legs 6 near the front. Said fixed legs having a wheel 7 at the bottom. A hydraulic leg 8 having a wheel 9 mounted between said rear legs 5 attached at one end to the lower rear transverse member 4. Also shown are transverse members 10 attached to and spaced along the top of lower longitudinal members 2 for supporting adjustable vehicle treads 11. Said vehicle treads being sectionalized and removable and old in the art. Said vehicle treads 11 for the purpose of supporting the wheels of the vehicle being repaired and are adjustable longitudinally of the supporting transverse members 10 so as to accommodate vehicles of differing wheel bases. FIG. 1*a* also shows upper longituding members 12 spaced apart and fixedly attached at their ends by an upper front transverse member 13 and an upper rear transverse member 14. Said upper members are added to provide greater strength and provide an additional support point for the L-shaped frame which will be further described herein. It should be noted that the upper members need not be constructed of heavy materials and may be used only for holding the fixed transverse members in place and for providing a support for additional adjustable transverse member 15 at a higher level where desirable. Where heavy vehicles such as large trucks are repaired, it is recommended that the upper members be of the same strength as the lower members thereby imparting greater strength to the entire structure. Although the drawings show rectangular upper and lower members it is to be noted that circular tubes may be used as equivalent structure for the upper and lower members previously described. FIGS. 2*a* and 2*b* show the L-shaped member 16 having a base 17 with transverse members 18 and 19 attached at either end each providing a mounting for wheels 20. Said wheels 20 being mounted in a tricycle arrangement although any supporting arrangement is adequate. The base 17 supports two vertical members 21 and 22. The longer member 21, for supporting any conventional pulling device, being composed of two vertical tubular sections the ends of which are fixedly attached to and on either side of the base 17. The longer vertical section 21 may alternatively be constructed of a singular tubular section as well. Attached at one end to vertical section 21 is a horizontal member 23 which is parallel to and above the base 17. The shorter vertical member 22 is attached at one end to the base 17 and near the other end to the horizontal member 23. A small portion of the vertical section 22 is allowed to extend slightly above the horizontal section 23. This provides a stop against which the upper members of the horizontal frame 1 will rest to provide workmen with sufficient working area about the L-shaped device to install and adjust the pulling devices to be mounted on the vertical member 21. Horizontal member 23 is of a slightly smaller vertical dimension than the transverse member 10 and is vertically positioned such that horizontal member 23 may be inserted into the slot created between the upper members 12, 13 and 14 and lower members 2, 3 and 4 previously described, by the transverse members 10. Reinforcement plates 47 may be added above and below member 23 and above the base 17 between vertical member 22 and the end of base 17 for additional strength.

Figure 7A:
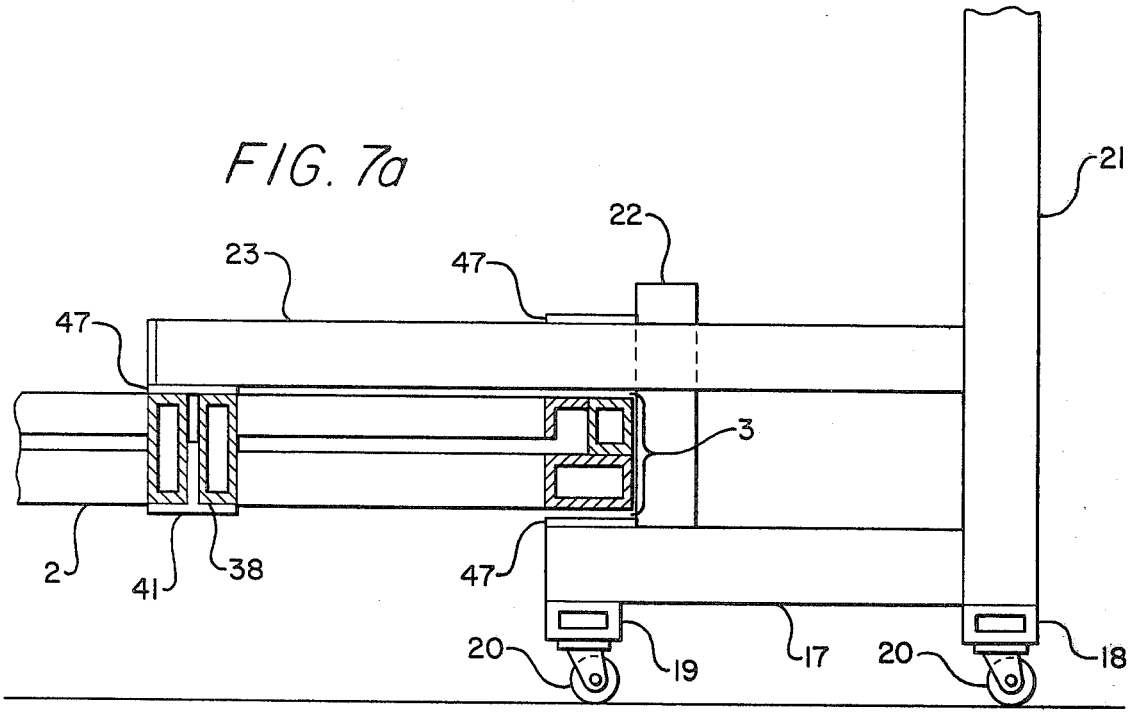
FIGS. 7*a* and 7*b* is a view of the L-shaped frame receiving the lower members of horizontal frame 1 in binding contact therewith and with adjustable transverse member 38. The upper portion of frame 1 is omitted for clarity.
Figure 7B:
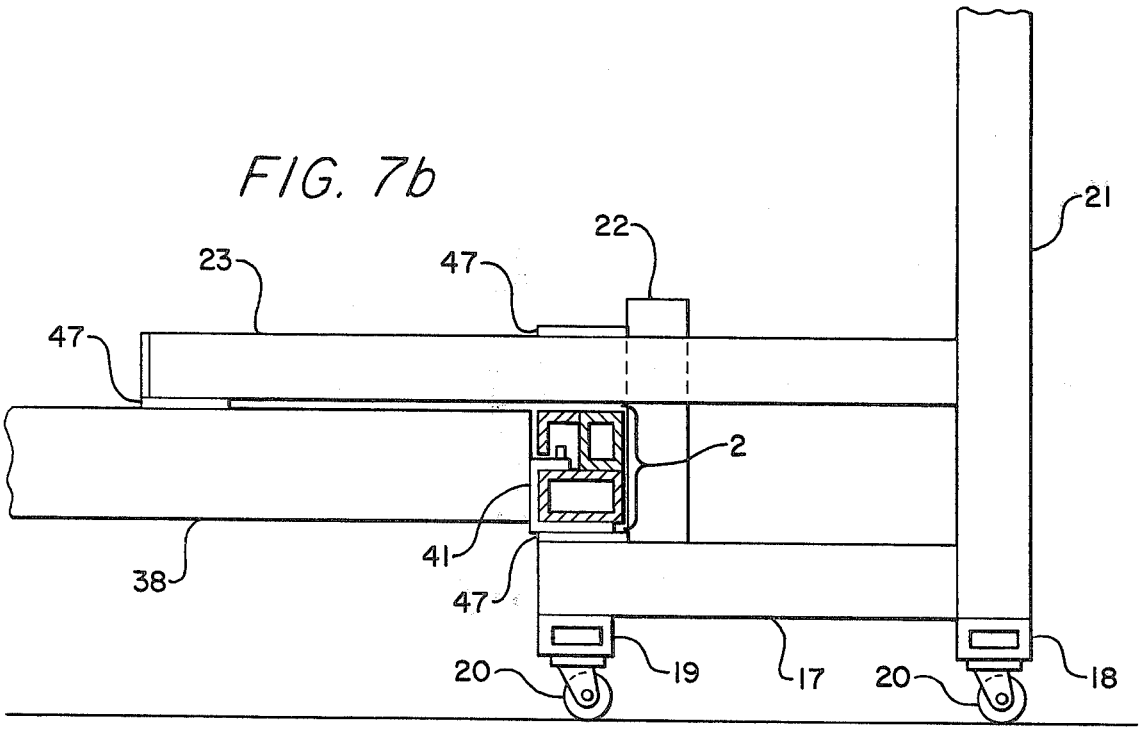

FIG. 7*a* shows the manner in which the horizontal member 23 of L-shaped member 16 receives the lower members 3 of frame 1 and bindingly engages the adjustable transverse member 38 when said L-shaped frame is used at the front of frame 1. The manner of operation of the L-shaped frame is identical at the rear of the frame. Therefore only the operation at the front of frame 1 is displayed. The small space between 3 and plate 47 on the base 17 is closed when the pulling force is applied to member 21 thus allowing the base 17 to come into binding contact with member 3 through plate 47. FIG. 7*b* shows the manner in which the horizontal member 23 of L-shaped member 16 receives the lower member 2 of frame 1 and bindingly engages the adjustable transverse member 38 when said L-shaped frame is used at the sides of frame 1.

When L-shaped member 16 is so inserted an adjustable transverse member 38 as shown in FIG. 1 may be adjusted longitudinally of frame 1 and positioned underneath the horizontal member 23 of the L-shaped frame. When a pulling force is applied to member 21 and directed inwardly toward frame 1, member 23 comes into binding contact with adjustable transverse member 38 at one reinforcement plate. The base 17 of the L-shaped member, likewise, comes into binding contact with the lower members 2, 3 or 4 of frame 1 depending on the position of L-shaped member about frame 1 at another reinforcement plate 47 attached to the top of the base. The remaining reinforcement plate 47 attached to the top of member 23 is added where the stronger frame construction for heavy vehicles is desired thus also allowing the upper horizontal frame to come into binding contact with member 23. Where a lighter frame construction is desired member 23 does not come into binding contact with the upper horizontal frame and accordingly the reinforcement plate 47 attached to the top of member 23 need not be used. In the specific embodiment shown in the drawings the heavy frame construction is shown and therefore, horizontal member 23 comes into binding contact with upper members 12, 13 or 14. These points of contact when a force is applied prevent rotation of the L-shaped member 16 and such member is held in place without any other means of connection to frame 1 except through the pulling chain or cable 36, a pulling device 37 and the load.

Figure 3A:
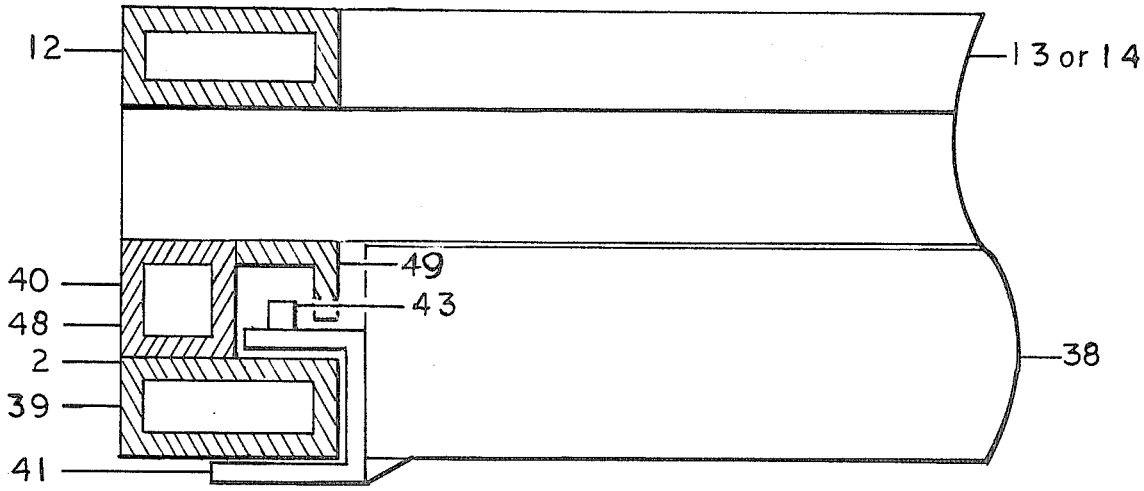
FIG. 3*a* is a sectional view of a longitudinal member showing the method of attaching the lower adjustable transverse member.
Figure 3B:
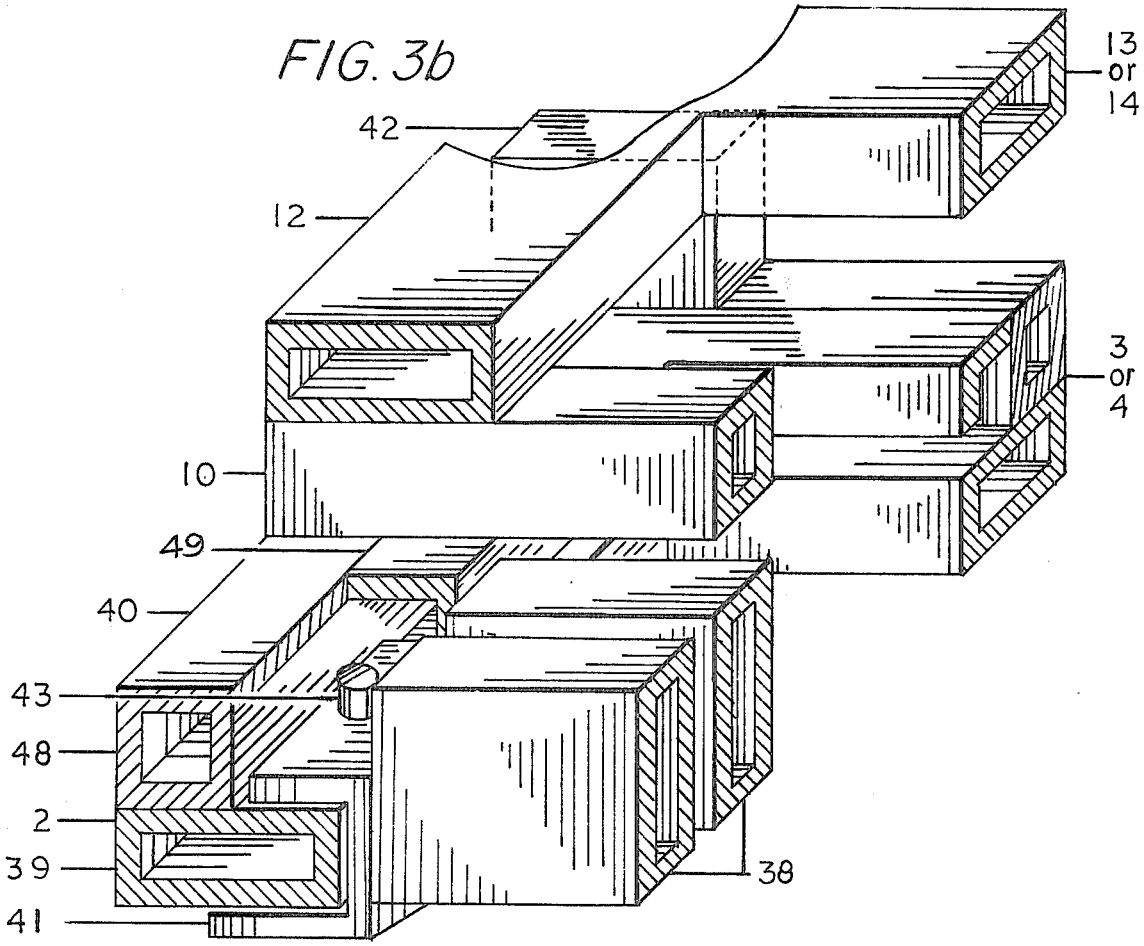
FIG. 3*b* is a sectional view in perspective of the method of attaching the lower adjustable transverse member to the longitudinal member and the spacers between the upper and lower horizontal members.

As shown in FIGS. 3*a* and 3*b*, the lower longitudinal members 2 comprise a lower member 39, which is the member giving strength to the structure and member 40 which comprise a tubular member 48 smaller than member 39 attached to one side of member 39 and an L-shaped member 49 attached to member 48 forming the member 40 as shown in FIGS. 3*a* and 3*b*. Transverse member 38 comprises two tubular sections spaced apart and connected at either end to the bight of a U-shaped member 41. Said U-shaped member 41 receiving lower member 39 and having a pin 43 on one arm of the U for contact against member 40 thereby preventing removal of member 41 from cooperation with member 2. In this configuration vertical forces on member 38, in either direction are applied directly to member 39 through the arms of the U and there is no distention of the slot formed between member 39 and member 40. Further one arm of the U-shaped member 41 is clamped between L-shaped member 16 and member 39 when pulling from the side of frame 1 resulting in additional strength placed at the point of greatest stress.

FIG. 3*b* also shows fixed transverse member 10, and a spacer 42 which support the upper members 12, 13 and 14, also shown. Spacer 42 is used at the four corners of the frame 1 so as to allow insertion of the L-shaped member 16 from the front and rear of the frame as well as the sides. Although the transverse member 10 would provide the proper spacing it is clear that it would prevent use of the L-shaped member 16 at the front and rear of frame 1. Hence, spacers 42 are used which provide the same spacing as transverse member 10.

Figure 4:
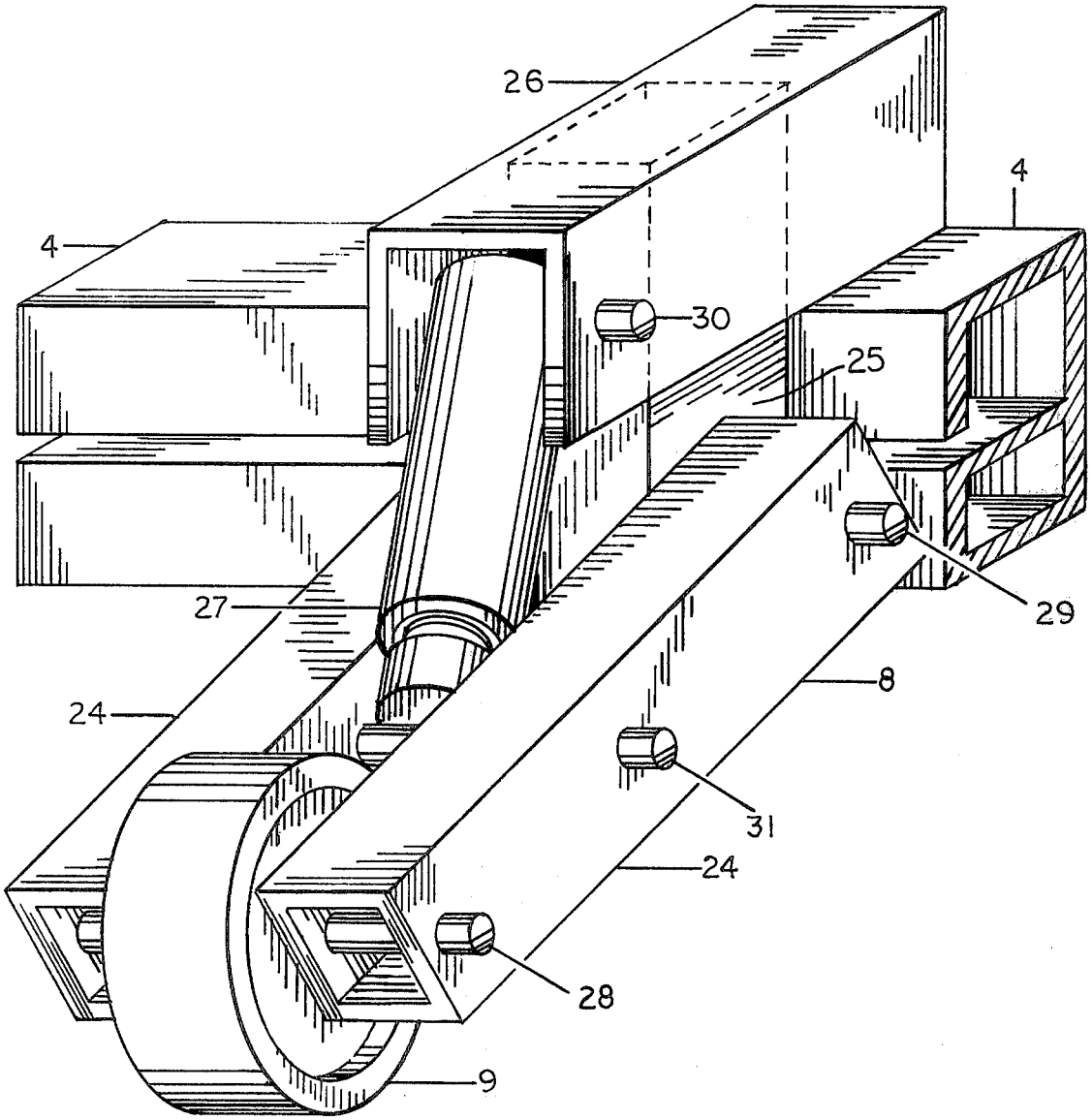
FIG. 4 is a detailed view of the hydraulic leg used to raise and lower the rear of the horizontal frame.

As shown in FIG. 4 the hydraulic leg 8 of FIG. 1 comprises a double leg 24 having a wheel attached by a pin 28 at one end between said double leg, and rotatably attached by a pin 29 at the other end to a verticle member 25. Member 25 is fixedly attached at the top and the sides to an inverted U-shaped member 26 at the bight of the U and at the bottom and side to rear transverse member 4, shown in section in FIG. 4. A conventional hydraulic unit 27 is rotatably attached at one end by a pin 30 to the arms of member 26 and rotatably attached by a pin 31 at the other between the arms of double leg 24. Since the hydraulic unit 27 and double leg 24 rotate about different axes, expansion and contraction of the hydraulic unit caused lowering and raising of the double leg 24.

Figure 5:
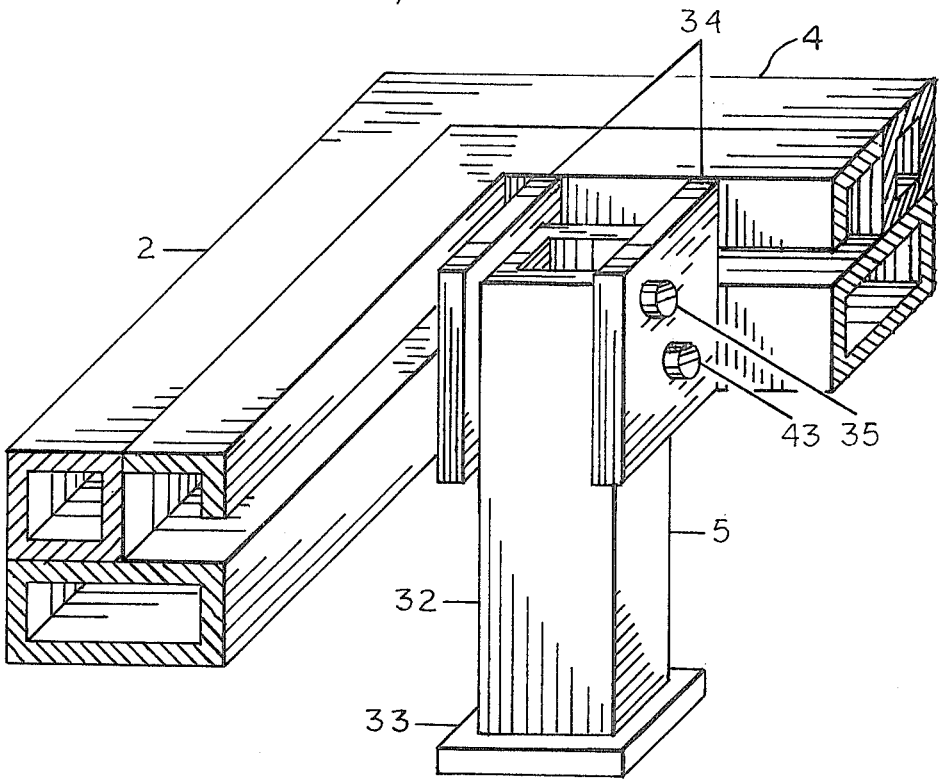
FIG. 5 is a detailed view of a rotatable rear leg of the horizontal frame.

As shown in FIG. 5, the rotatable leg 5, comprises a hollow tubular member 32, having a base plate 33 at one end and is rotatably secured to a pair of arms 34 by a first pin 35 at the other end. Said member 32 having a hole for receiving a second pin 43. Said arms 34 are attached to lower rear transverse member 4, and also have a hole for receiving second pin 43. When the rotatable leg is vertical or in the down position the holes for receiving second pin 43 are registered and said pin may be inserted so as to fix the position of the rotatable leg 5. When the rotatable leg is in the up position the second pin 43 may be inserted through only the arms 34, member 32 being prevented from returning to the vertical position by contact with pin 43 across the top of member 32. For clarity only the lower portion of the frame is shown.

Figure 6:
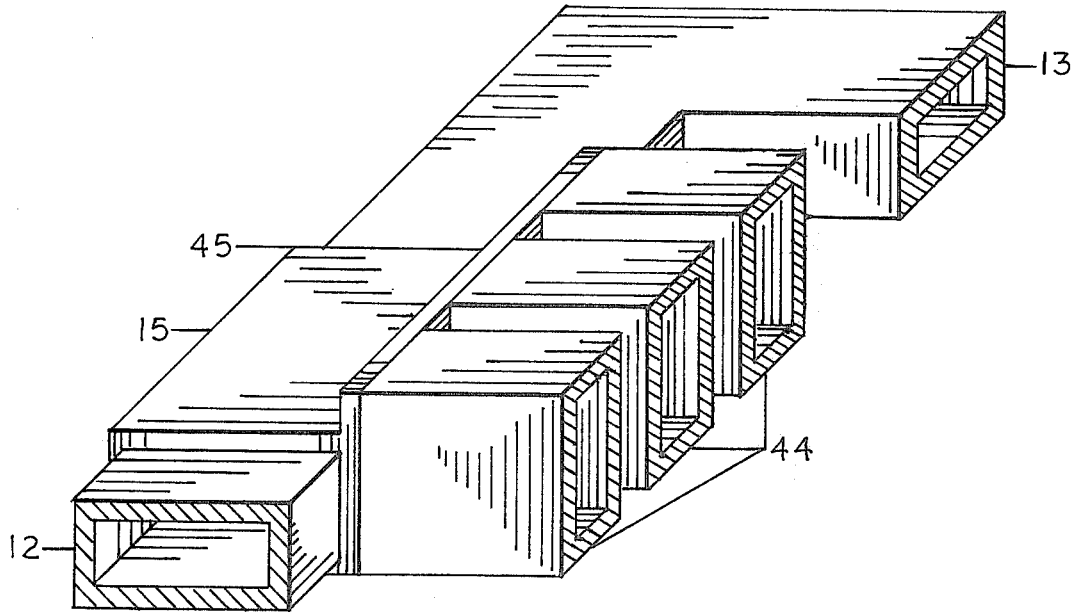
FIG. 6 is a sectional view of method of attaching upper adjustable transverse member to the longitudinal member.

As shown in FIG. 6, the upper transverse member 15 comprises three tubular members 44 attached at either end to a second tubular member 45 which receives member 12 and is slideably attached to member 12 but cannot be removed therefrom.

For clarity only the upper portion of frame is shown.

What is claimed is:

1. A body and frame straightening machine comprising:

a. means for supporting a vehicle; said means further comprising:
   1. a plurality of horizontally disposed longitudinal side members spaced apart;
   2. at least one front transverse member fixedly attached to the front ends of said longitudinal side members;
   3. at least one rear transverse member fixedly attached to the rear ends of said longitudinal side members, whereby said longitudinal side members and said transverse members form a horizontally disposed frame; and
   4. at least one adjustable transverse member slideably attached to said longitudinal side members.

b. means for bindingly engaging and adapted for receiving said support means, having a generally L shape frame further comprising:
   1. a base;
   2. a first vertical member attached at one end of the base adapted for supporting a pulling force means;
   3. a second vertical member, shorter than the first, attached at one end of the base at a point remote from the opposite end of the base and spaced apart from the first vertical member; and
   4. a horizontal member above the base longer than the base attached at one end to the first vertical member and attached at a point remote from the other end to the second vertical member and parallel to the base, whereby a slot is formed between the horizontal member and said base for receiving said horizontally disposed frame and whereby said horizontal member extends further into said horizontally disposed frame than said base and cooperates with the upper portion of said adjustable transverse member and the base of said L frame cooperates with said horizontally disposed frame at the bottom and below said horizontally disposed frame thereby preventing relative movement between said horizontally disposed frame and said L shaped frame when a pulling force is applied thereto by said pulling force means.

c. means for anchoring said vehicle to said support means, whereby a pulling force may be applied to a damaged vehicle such that said damaged vehicle is returned to its original configuration.

2. A body and frame straightening machine comprising:

a. a plurality of lower horizontally disposed longitudinal side members spaced apart;

b. a lower front transverse member fixedly attached to the front ends of said lower longitudinal side members;

c. a lower rear transverse member fixedly attached to the rear ends of said lower longitudinal side members, whereby said lower longitudinal side members and said lower transverse members form a lower horizontally disposed frame;

d. a plurality of fixed transverse members attached to the top of and spaced longitudinally of said lower longitudinal side members;

e. a plurality of upper longitudinal side members attached on the top of said fixed transverse members;

f. an upper front transverse member fixedly attached to the front ends of said upper longitudinal side members;

g. an upper rear transverse member fixedly attached to the rear ends of said upper longitudinal side members; whereby said upper longitudinal side members and said upper transverse members form an upper horizontally disposed frame; spaced apart from said lower horizontally disposed frame forming a horizontal slot about the perimeter of the machine;

h. at least one lower adjustable transverse member slideably attached to said lower longitudinal side members;

i. an L-shaped frame adapted for insertion into said horizontal slot, adapted for receiving said lower horizontally disposed frame and cooperating with said adjustable transverse member and said lower horizontally disposed frame, whereby relative movement between said L-shaped frame and said lower horizontally disposed frame is prevented when a pulling force is applied between said L-shaped frame and said lower horizontally disposed frame;

j. a means for applying said pulling force between said vehicle and said L-shaped frame; and k. a means for anchoring said vehicle to said horizontal frames.

* * * * *